US010737192B1

(12) United States Patent
Pack

(10) Patent No.: US 10,737,192 B1
(45) Date of Patent: Aug. 11, 2020

(54) CONSTRUCTION BLOCK ASSEMBLY SET

(71) Applicant: David T. Pack, Glendale Heights, IL (US)

(72) Inventor: David T. Pack, Glendale Heights, IL (US)

( * ) Notice: Subject to any disclaimer, the term of this patent is extended or adjusted under 35 U.S.C. 154(b) by 0 days.

(21) Appl. No.: 16/420,810

(22) Filed: May 23, 2019

(51) Int. Cl.
*A63H 33/10* (2006.01)
*A63H 33/00* (2006.01)
*A63H 33/16* (2006.01)

(52) U.S. Cl.
CPC ..... *A63H 33/101* (2013.01); *A63H 33/008* (2013.01); *A63H 33/16* (2013.01)

(58) Field of Classification Search
CPC ..... A63H 33/101; A63H 33/008; A63H 33/16
USPC ..... 446/124; 229/125, 125.19, 125.21
See application file for complete search history.

(56) References Cited

U.S. PATENT DOCUMENTS 1,398,852 A * 11/1921 Gilbert ..... A63H 33/102 446/112
1,960,925 A * 5/1934 Senat ..... B65D 5/14 229/109
3,460,860 A * 8/1969 Stevens, Jr. ..... E04F 19/064 52/584.1
3,611,617 A * 10/1971 Foster ..... A63H 33/16 446/487
3,998,002 A * 12/1976 Nathanson ..... A63H 33/105 446/115
4,296,524 A * 10/1981 Horholt ..... F16B 5/0028 16/225
4,608,799 A * 9/1986 Hasegawa ..... A63H 33/10 446/112
5,161,909 A * 11/1992 Crouse ..... E06C 1/16 182/127
5,295,632 A * 3/1994 Zink ..... B65D 5/0055 229/117.16
6,997,458 B1 * 2/2006 Yokomi ..... A63F 9/0415 273/146
7,444,792 B2 * 11/2008 Matson ..... E04D 12/00 24/336

* cited by examiner

*Primary Examiner* — Vishu K Mendiratta
(74) *Attorney, Agent, or Firm* — Justin Lampel

(57) ABSTRACT

A construction blocks assembly set is provided. The construction block assembly set has a plurality of generally flat boxes which may be folded into generally cube, rectangle, prisms or other shaped boxes. The boxes may be easily folded and secured in the folded orientation (cube, prism, etc) without the need for tape or other securing devices. Openings on the boxes allow for a clip to be inserted into in order to secure multiple boxes together to form a fort, a house, a clubhouse, a storefront, a castle building or other structure.

6 Claims, 5 Drawing Sheets

CONSTRUCTION BLOCK ASSEMBLY SET

BACKGROUND OF THE INVENTION

A construction blocks assembly set is provided. The construction block assembly set has a plurality of generally flat boxes which may be folded into generally cube, rectangle, prisms or other shaped boxes. The boxes may be easily folded and secured in the folded orientation (cube, prism, etc) without the need for tape or other securing devices. Openings on the boxes allow for a clip to be inserted into in order to secure multiple boxes together to form a fort, a house, a clubhouse, a storefront, a castle building or other structure.

Children have long used boxes to make forts and other buildings. Cardboard boxes are especially popular for this type of fort and building construction. Patents related to using boxes for forts and buildings are known. For example, U.S. Pat. No. 5,330,379 to Roh discloses a toy that can be stored as a sofa having a bench, a backrest and a headrest and that can be taken apart to build structures large enough for a child to crawl through or play in. The toy is a construction set with a plurality of first, second and third pieces. The first pieces form the bench, the second pieces form the backrest and the third pieces form the headrest. The pieces are solids with planar faces and are rearrangable into a play house having sidewalls, gables and a roof wherein the first pieces form the sidewalls, the second pieces form the roof and the third pieces for-the gables. Pairs of fasteners of opposite gender are arranged on the faces of the first, second and third pieces for joining the pieces into the sofa, the play house and other structures. Even numbers of pairs of fasteners of opposite polarity are provided for joining the pieces in more than one orientation.

Further, U.S. Pat. No. 4,978,301 to Dodge discloses a construction set suitable and safe for children of various ages comprising construction pieces and connector strips. The construction pieces have a semirigid planar construction with opposing major sides which have hook fastener material disposed on one side and loop pile fastener material disposed on the other. The fastener materials are of the type which adhere when pressed together. An outer border or margin area of the construction pieces is kept free of the fastener materials, to provide a tab or hem for separating attached pieces. The construction pieces have various shapes and sizes with which many designs and structures may be constructed. The connector strips have a similar construction to the construction pieces and are used to join adjacent construction pieces. The sides may include complementary colors and patterns.

However, these patents fail to describe a construction block assembly set which is easy to use. Further, these patents fail to provide for a construction block assembly set which allows a child to easily assemble and disassemble a fort, a house, a clubhouse, a storefront, a castle or other structure.

SUMMARY OF THE INVENTION

A construction blocks assembly set is provided. The construction block assembly set has a plurality of generally flat boxes which may be folded into generally cube, rectangle, prisms or other shaped boxes. The boxes may be easily folded and secured in the folded orientation (cube, prism, etc) without the need for tape or other securing devices. Openings on the boxes allow for a clip to be inserted into in order to secure multiple boxes together to form a fort, a house, a clubhouse, a storefront, a castle building or other structure.

An advantage of the present construction block assembly set is that the individual boxes may be shipped and/or stored in a flat orientation prior to or after use.

And another advantage of the present construction block assembly set is that the individual boxes may be easily converted from a flat orientation to the cubical (prism) orientation.

Yet another advantage of the present construction block assembly set is that the individual boxes may be converted into the cubical (prism) orientation from the flat orientation and then easily converted back to the flat orientation for storage and later use.

Still another advantage of the present construction block assembly set is that the present set allows for an individual to build a solid and stable structure both vertically and horizontally.

And another advantage of the present construction block assembly set is that the present set allows an individual to create original building structures to help encourage creativity.

For a more complete understanding of the above listed features and advantages of the construction block assembly set system reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A construction blocks assembly set is provided. The construction block assembly set has a plurality of generally flat boxes which may be folded into generally cube, rectangle, prisms or other shaped boxes. The boxes may be easily folded and secured in the folded orientation (cube, prism, etc) without the need for tape or other securing devices. Openings on the boxes allow for a clip to be inserted into in order to secure multiple boxes together to form a fort, a house, a clubhouse, a storefront, a castle building or other structure.

Figure 1:
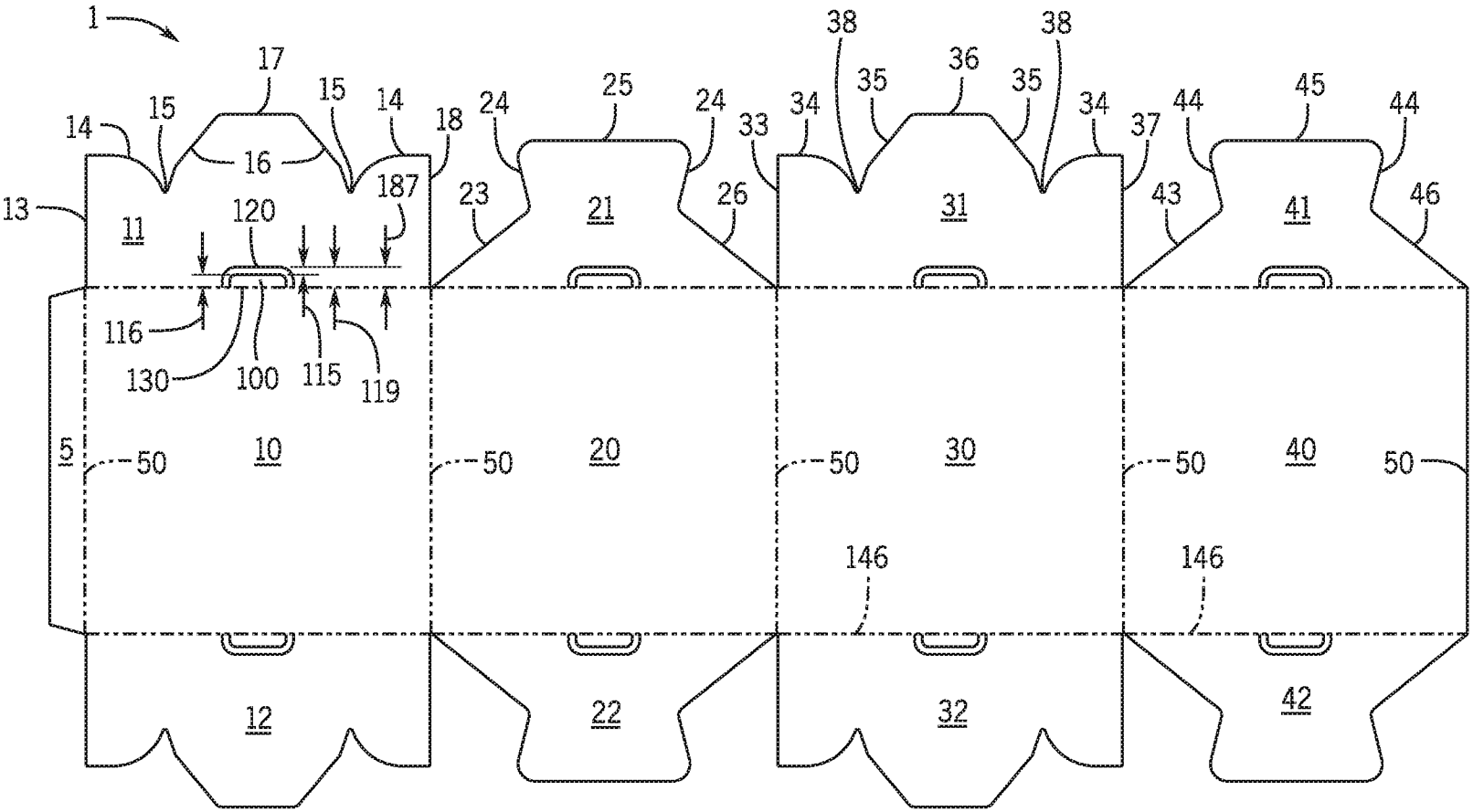
FIG. 1 illustrates a view of one of the individual boxes in the flat orientation.
Figure 3:
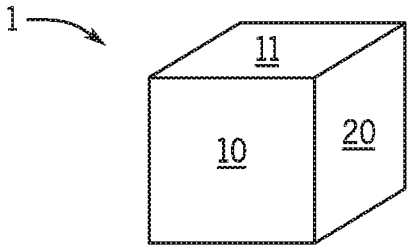
FIG. 3 illustrates a perspective view of one of the individual boxes in the prism (cubic) orientation.

Referring first to FIG. 1, in an embodiment, a construction block assembly set system is provided. The construction block assembly set system is made of a plurality of individual units (or boxes) 1. The individual boxes 1 may be transformed from, for example, a generally flat orientation as shown in FIG. 1 to a generally cubic (prism) orientation as shown in FIG. 3. It should be understood that the boxes 1 may be assembled in other shapes such as, for example, rectangular boxes without deviating from the present assembly set concept. Preferably, the boxes 1 are made of a durable cardboard, plastic or other light weight and durable material.

In an embodiment, each of the plurality of boxes 1 may have a first face 10, a second face 20, a third face 30 and a fourth face 40. The first face 10 may have a first flap 11 and a second flap 12; the second face 20 may have a first flap 21 and a second flap 22; the third face 30 may have a first flap 31 and a second flap 32; and the fourth face 40 may have a first flap 41 and a second flap 42. A plurality of creases 50 may be located between any two faces 10, 20, 30 and 40 and may allow any two adjacent faces 10, 20, 30 and 40 to bend with respect to one another; preferably ninety degrees. The first face 10 of the box may also have a short extended flap 5 which is smaller than the other faces 10, 20, 30 and 40 and wherein the short extended flap 5 folds inward and connects the first face 10 with the fourth face 40 in the assembled form illustrated in FIG. 3.

In an embodiment, the first flap 11 of the first face 10 and the first flap 31 of the third face 30 may be identical and, in an embodiment, the first flap 21 of the second face 20 and the first flap 41 of the fourth flap 40 may be identical. Still further, the second flap 12 of the first face 10 and the second flap 32 of the third face 30 may be identical and the second flap 22 of the second face 20 and the second flap 42 of the fourth face 40 may be identical. This may allow the box 1 to be easily and quickly folded from the flat orientation of FIG. 1 to the folded orientation of FIG. 3. In an embodiment, the box 1 may be folded and secured in the folded orientation of FIG. 3 without the aid of securing items such as tape or glue.

In an embodiment, first flaps 11, 21, 31 and 41 and the second flaps 12, 22, 32 and 42 may each have a cut-out section 120. Preferably, the cut-out section 120 is generally rectangular with curved edges; however, the cut-out section 120 may be of various shapes. The cut-out sections 120 may be located, in an embodiment, on all the first flaps 11, 21, 31 and 41 and all the second flaps 12, 22, 32, and 42. As a result, a user may build various structures 412 (FIG. 8) using multiple boxes 1 in multiple orientations (as discussed below). In an embodiment, the cut-out sections 120 are located at a bendable crease 146 located between the flaps 11, 12, 21, 22, 31, 32, 41 and 42 the faces 10, 20, 30 and 40 of the boxes 1. Therefore, each face 10, 20, 30 and 40 is surrounded by creases 50, 146 on all four sides.

The cut-out sections 120 may have a width 187 which defines the distance from the crease 146 to the farthest portion of the cut-out portion 120 (with respect to the faces). The cut-out portions 120 may have a tab 100 which folds at a crease 130. The tab 100 may have a width 116 which is less than the width 187 of the cut-out section 120. As a result, a space 115 is created, in an embodiment, between the tab 100 and the end of the cut-out section 120.

In an embodiment, the first flap 11 of the first face 10 may have a first side 13, a second side 18 and a distal end 17. The first flap 11 of the first face 10 may have a curved section 14 that curves inward from each of the sides 13, 18 and comes to a point 15. The second flap 12 of the first face 10 may mirror that of the first flap 11 of the first face 10.

In an embodiment, the first flap 21 of the second face 20 may have a slanted first side 23, a slanted second side 26 and a distal end 25. The slanted portions 23, 26 may meet at a less slanted section 24 attached to the distal end 25. The second flap 22 of the second face 20 may mirror that of the first flap 21 of the second face 20.

In an embodiment, the first flap 31 of the third face 30 may have a first side 33, a second side 37 and a distal end 36. The first flap 31 of the third face 30 may have a curved section 34 that curves inward from the sides 33, 37 and comes to a point 38. The second flap 32 of the third face 30 may mirror that of the first flap 31 of the third face 30.

In an embodiment, the first flap 41 of the fourth face 40 may have a slanted first side 43, a slanted second side 46 and a distal end 45. The slanted portions 43, 46 may meet at a less slanted section 44 attached to the distal end 45. The second flap 42 of the fourth face 40 may mirror that of the first flap 41 of the fourth face 40.

Figure 8:
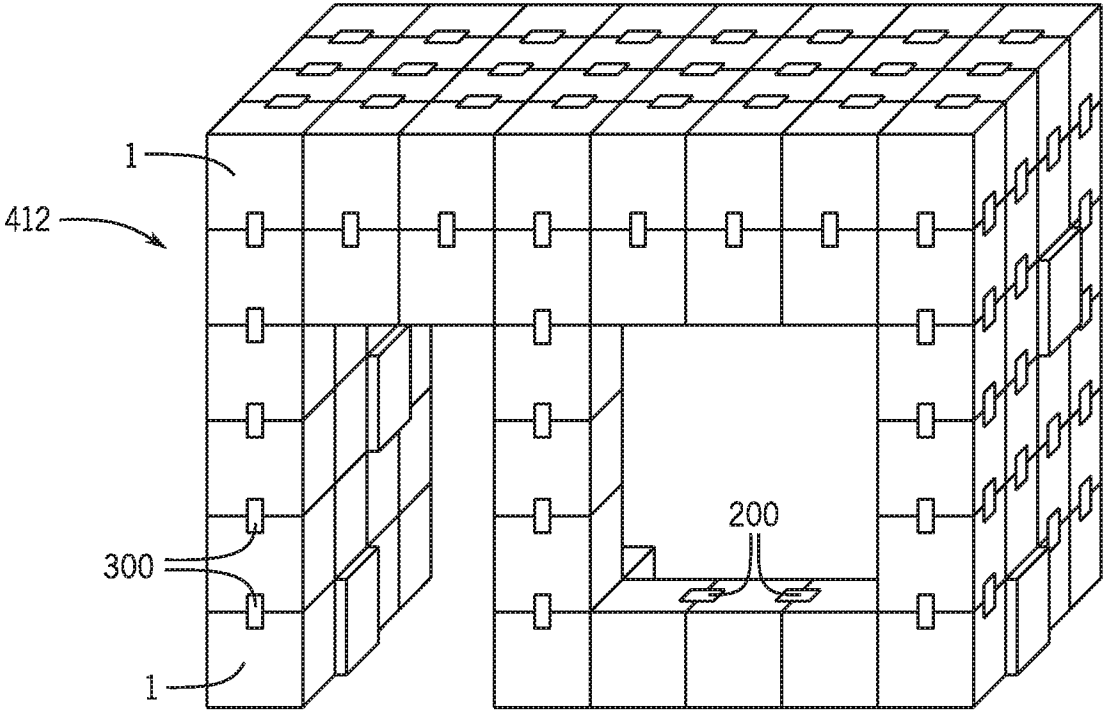
FIG. 8 illustrates one embodiment of an assembled fort, a house, a clubhouse, a storefront, a castle or other structure made of a plurality of assembled boxes of the set.

Once a single individual box 1 is assembled into the cubic (prism) orientation of FIG. 3, multiple boxes 1 may then be secured together to form a structure 412; an example of which is shown in FIG. 8. In order to secure multiple boxes 1 together so that the structure 412 does not easily fall apart, a securing device to secure multiple boxes 1 together is needed.

Figure 2:
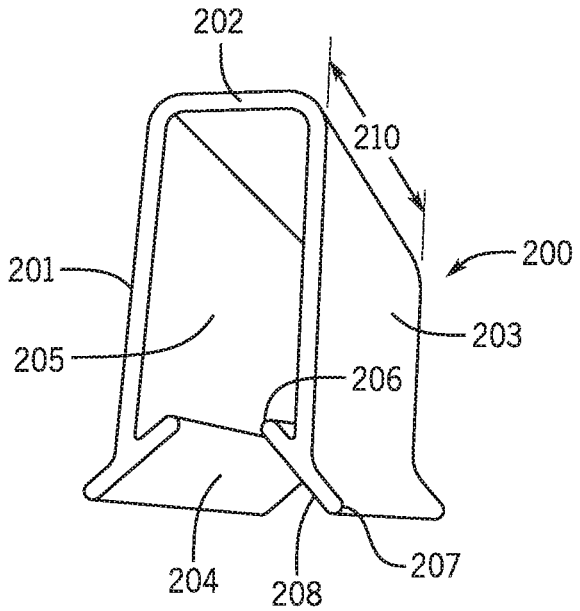
FIG. 2 illustrates a perspective view of one of the main securing clips of the set.
Figure 5:
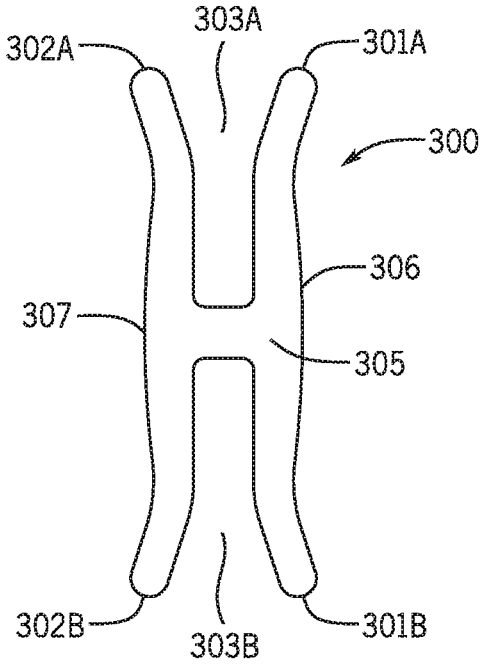
FIG. 5 illustrates a side view of one of the plurality of stacking clips of the set in an embodiment.

Referring now to FIG. 2, in an embodiment, the construction set system may have a plurality of main securing clip 200 and a plurality of stacking clip 300 (FIG. 5). The main securing clip 200 may be generally u-shaped having a top 202, a first side 201 and a second side 203. The bottom 204 of the main securing clip 200 may be open so as to receive a portion of the box 1 within an interior 205 of the main securing clip 200 (as discussed below).

The bottom 204 of the main securing clip 200 may have a first inclined surface 204 and a second inclined surface 208 wherein each include surface 204, 208 has an interior end 206 (located within the interior 205) and an exterior end 207. The inclined surfaces 204, 208 may be angled with respect to the first side 201 and second side 203 of the main securing clip 200. In an embodiment, the first included surface 204 and the second inclined surface 208 each have an axis that meets at approximately a ninety-degree angle with respect to each other. More particular, in an embodiment, the inclined surfaces 208 may extend approximately thirty-five to fifty-five degrees with respect to the sides 201, 203 of the securing clip 200.

To convert a box from the flat orientation of FIG. 1 into the cubic (prism) orientation of FIG. 3, all the creases 50 are bent approximately ninety degrees so that each face 10, 20, 30 and 40 are at right angles with respect to each other. The flaps 11, 12, 21, 22, 31, 32, 41 and 41 are then all folded inward at crease 146 and the tops and bottom of each box 1 are then sealed by using the flaps 11, 21, 31, 41, 12, 22, 32, and 42, without the need to tape, glue or other securing devices.

Figure 4:
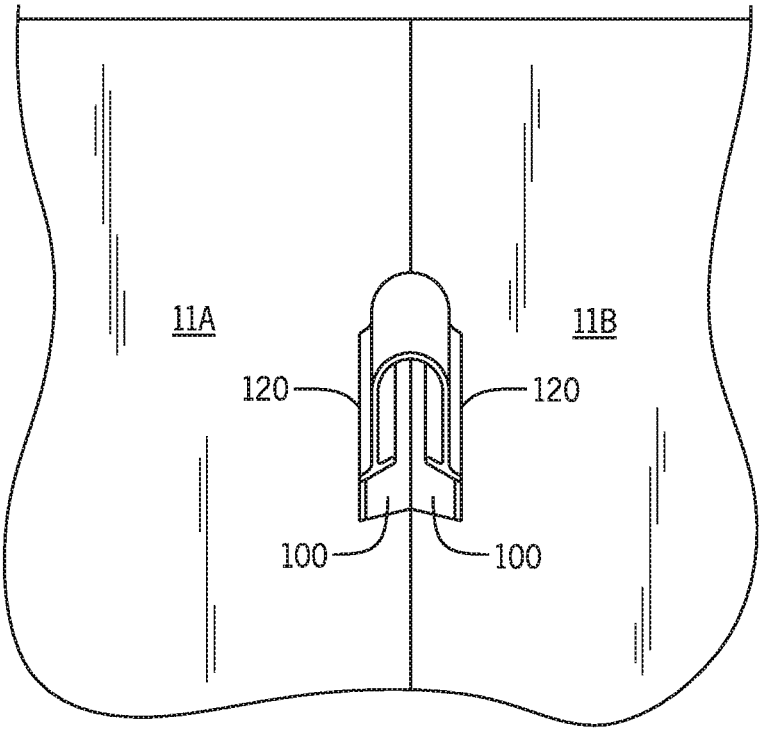
FIG. 4 illustrates a top view of one of the plurality of main securing clips being used to secure two of the individual boxes together.
Figure 7:
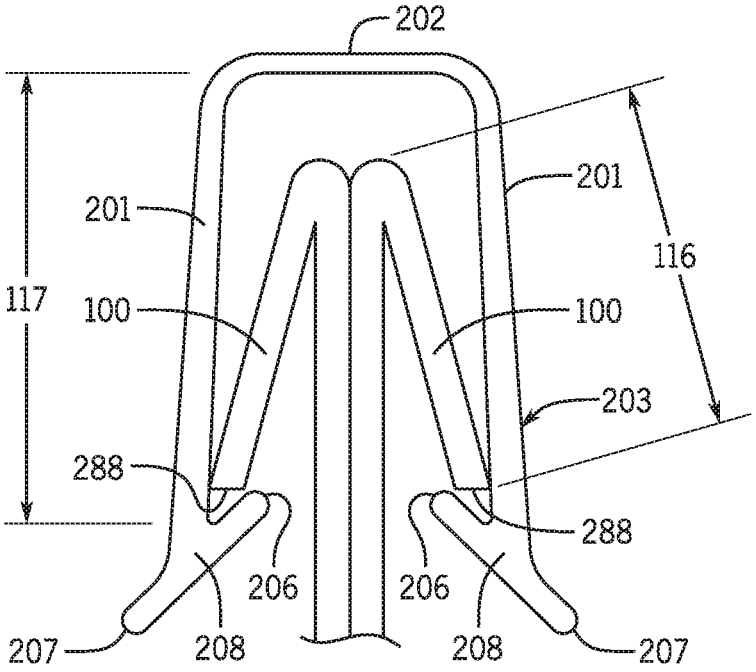
FIG. 7 illustrates a cross sectional side view of the main securing clip being used to secure two assembled individual boxes together.

Once an individual box 1 is folded into the cubic orientation of FIG. 3, the tab 100 of a desired flap 11, 12, 21, 22, 31, 32, 41 or 42 is pushed downward, into the interior of that box 1. More specifically, the desired tabs 100 may be folded at a crease 130 to create a larger opening for the cut-out section 120. When two separate boxes 1 are placed next to each other, as shown in FIG. 4 (as 11A and 11B), the main securing clip 200 may be pushed down (straddling the two individual boxes 11A and 11B) so that the first side 201 of one main securing clip 200 goes in the cut-out portion 120 of one box (and partially within the interior of that box) and the second side 203 of the same main securing clip 200 goes into the cut-out portion 120 of an adjacent box 1 (and partially within the interior of that box). In an embodiment, the first inclined surface 204 may therein grasp and secure the tab 100 of the first box 1 while the second inclined surface 208 of the same main securing clip 200 grasps and secures the tab 100 of the cut-out portion 120 of the adjacent box. When this is done, ends 288 (FIG. 7) of the tabs 100 are temporarily trapped by the inclined surfaces 208 as shown in the cross-sectional view of FIG. 7. In an embodiment, the tabs 100 may have a 116 width. The width 116 of the tab 100 is less than the interior length 117 of the interior 205 of the main securing clip 200 so that the tab 100 may snugly fit within the interior 205 of the main securing clip 200.

Referring now to FIG. 5, in an embodiment, one of a plurality of stacking clips 300 is provided. Each of the stacking clips 300 may have a first side 306 and a second side 307. The first side 306 may have a first end 301A and a second end 301B. The second side 307 may have a first end 302A and a second end 302B. The first side 306 and the second side 307 may be secured together by a middle section 305. In an embodiment, the middle section 305 equally divides the stacking clip 300 both vertically and horizontally in half. An opening slot 303A may be located between the first end 301A of the first side 306 and the first end 302A of the second side 307. An opening slot 303B may also be located between the second end 301B of the first side 306 and the second end 302B of the second side 307.

Figure 6:
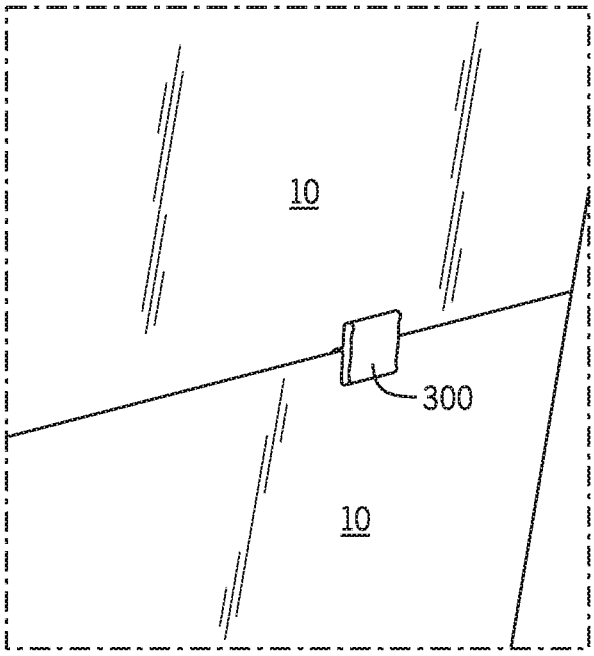
FIG. 6 illustrates a side view of one of the stacking clips used to secure one assembled box on top of a second assembled box.

The second opening 303B of the stacking clip 300 may be pushed downward within the opening 120 of a box 1 (with the tab 100 pushed down) so that the second side 307 of the stacking clip 300 goes into the opening 120 (and interior) of the box 1 while the first side 306 of the stacking clip 300 remains outside of the interior of that box 1. Therefore, the stacking clip 300 straddles the side of the box 1. Once in place, a separate second box 1 may be place on top of the first box 1 in the same manner so that the first opening 303A of the stacking clip 300 enters the opening 120 on the underside of a box 1 located directly above the first box 1 (as shown in FIG. 6). The boxes 1 may then remained secured together and prevented from shifting, along with the aid of gravity. The main securing clip 200 is ideal for securing two adjacent boxes 1 together in a horizontal manner (with respect to the ground) while the stacking clip 300 is ideal for vertical stacking. In an embodiment, a user may decide not to use the stacking clip 300 on the exterior wall boxes for aesthetic reasons (although FIG. 8 illustrates the exterior wall boxes with stacking clips 300). To remove two boxes 1 from each other (either vertical or horizonal) a slight pulling on the clips 200, 300 or boxes 1 themselves separates the boxes 1. The boxes 1 may then be unfolded and stored in the flat orientation for later use.

Finally, in an embodiment not shown but generally understood, the box 1 may be folded generally in half for storage and or transportation and shipping. In particular, in this condensed orientation embodiment, the first face 10 and the second face 20 may be located one hundred and eighty degrees with respect to each other and may face upward and wherein the crease 50 between the second face 20 and the third face 30 is the only crease folded so that the third face 30 and fourth face 40 face downward and are at one hundred and eighty degrees with respect to each other. Therefore, the first face 10 and second face 20 are located above the third face 30 and fourth face 40 in this condensed version. Still further, all three creases 50 may be folded so that the box 1 may be stored and or shipped in an even smaller orientation of approximately one-fourth the surface area shown in FIG. 1.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A construction box assembly set system comprising:

a first unit capable of converting from a first orientation to a second orientation;

a crease located on the first unit wherein the crease is capable of allowing the first unit to bend at the crease in the forming of the second orientation;

a separate second unit capable converting from a first orientation to a second orientation;

wherein a portion of the first unit and a portion of the second unit are in contact with each other when secured together in the second orientation;

a crease located on the second unit wherein the crease is capable of allowing the second unit to bend at the crease in the forming of the second orientation;

an opening on the first unit and an opening on the second unit;

a securing clip having a first side and a second side wherein the securing clip is capable of securing the first unit to the second unit by inserting the first side of the securing clip into the opening of the first unit and inserting the second side of the securing clip into the opening of the second unit;

an inclined surface located at a bottom of the first side of the securing clip;

an inclined surface located at a bottom of the second side of the securing clip;

a tab located within the opening of the first unit;

wherein the inclined surface of the first side and the inclined surface of the second side of the securing clip remains stationary with respect to bottom of the first side and the second side of the securing clip and wherein the inclined surface of the first side and the inclined surface of the second side do not rotate with respect to the bottom of the securing clip, when the tab is inserted into the securing clip; and wherein the inclined surface of the first side and the second side of the securing clip is at an angle between thirty-five and fifty-five degrees with respect to the first side of the bottom of the securing clip.

2. The construction box assembly set system of claim 1 wherein the first orientation is generally flat and wherein the second orientation is a three dimensional orientation with respect to both the first unit and second unit.

3. The construction box assembly set system of claim 1 further comprising:

a bendable tab located within the opening of the first unit.

4. The construction box assembly set system of claim 3 wherein the bendable tab occupies less than the full area of the opening such that a portion of the opening remains unobstructed when the securing clip is not inserted into the first opening.

5. The construction box assembly set system of claim 1 wherein the first unit is capable of being secured in the second orientation without the need for an adhesive or other securing mechanism.

6. The construction box assembly set system of claim 1 wherein the second unit is capable of being secured in the second orientation without the need for an adhesive or other securing mechanism.

* * * * *